United States Patent [19]

Piontkowski et al.

[11] 4,090,271

[45] May 23, 1978

[54] CHIMNEY CLEANER

[76] Inventors: Carl F. Piontkowski, 38 Ridge Dr., Old Saybrook, Conn. 06475; George L. Yarocki, 408 Riverside Dr., Torrington, Conn. 06790

[21] Appl. No.: 755,483

[22] Filed: Dec. 29, 1976

[51] Int. Cl.[2] ..... F23J 3/02; B08B 9/02

[52] U.S. Cl. ..... 15/243

[58] Field of Search ..... 15/243, 162, 163, 104.18, 15/242

[56] References Cited

U.S. PATENT DOCUMENTS

| | | | |
|---|---|---|---|
| 1,464,249 | 8/1923 | Gramowski | 15/163 |
| 1,582,309 | 4/1926 | Satterberg | 15/243 |
| 1,615,733 | 1/1927 | Wold | 15/242 |
| 2,602,177 | 7/1952 | Aho | 15/163 |

*Primary Examiner*—Harvey C. Hornsby
*Assistant Examiner*—Timothy F. Simone
*Attorney, Agent, or Firm*—McCormick, Paulding & Huber

[57] ABSTRACT

A chimney cleaner designed to be lowered through a chimney from its upper end includes both scrubbing and chopping elements for removing soot, tar, mortar and the like from the chimney walls. The scrubbing elements are adjustable to suit various sizes of chimney flues and are so shaped and attached to a supporting frame as to be urged toward the chimney walls, by the weight of the cleaner as they encounter obstructions on the walls, to enhance their cleaning action.

7 Claims, 5 Drawing Figures

CHIMNEY CLEANER

BACKGROUND OF THE INVENTION

This invention relates to a chimney cleaner in the form of a device designed to be lowered through a chimney by means of a chain, rope or other flexible suspension member and having parts engageable with the chimney walls for removing obstructions and accumulations of undesired material, and deals more particularly with improvements in such a cleaner.

A general object of this invention is to provide a chimney cleaner which is of a relatively simple and economical construction but which nevertheless has the ability to clean various different obstructions and accumulations from chimney walls with a minimum amount of manual effort.

Other objects of the invention are to provide a chimney cleaner of the foregoing character which may be used to clean both masonry and metal chimney flues, which is usable to clean either excess mortar from new masonry chimneys or accumulations of soot, tar, or other combustion products from old chimneys, and which is readily adjustable to suit various different sizes of chimney flues.

Anoter object of the invention is to provide a chimney cleaner which is of an open design which allows it to be used while the chimney is in use with a fire, thus avoding the need for shutting down furnaces and heating systems and allowing the cleaner to be used while the chimney walls are warm which softens tar and tar-like accumulations and makes them easier to remove.

A still further object of the invention is to provide a chimney cleaner of the foregoing character having both scrub members for scrubbing accumulations from chimney walls and chopping elements for chopping away excess mortar chunks and other stubborn obstructions or for chopping a passageway through a severely clogged chimney as a first cleaning step prior to using the scrub members for a more complete cleaning.

Other objects and advantages will be apparent from the following description of a preferred embodiment and from the accompanying drawings.

SUMMARY OF THE INVENTION

This invention resides in a chimney cleaner having a frame adapted for suspension from a cable, chain, rope or other flexible support for the purpose of lowering it through a chimney flue and having two scrub members located on opposite sides of the vertical axis of the frame and pivotally connected thereto for movement about two spaced parallel pivot axes located in a common horizontal plane. The two scrub members extend generally downwardly from their pivot axes and each has a lower end portion providing a downwardly and outwardly facing end surface. Above its lower end portion each scrub member has an adjacent portion defining a generally outwardly and upwardly facing second surface, the first and second surfaces of each scrub member joining one another along a transition area at which the scrub member has a maximum spacing from the central axis of the frame. A holding means, which is preferably adjustable and which may be a turnbuckle carried by the frame, holds the two scrub members against movement inwardly toward the central frame axis beyond a given limit but allows at least a limited amount of movement outwardly away from the central axis beyond the inwardly limited positions to permit spreading of the transition areas of the scrub members beyond their minimum spacing by spreading forces applied thereto. As a result, as the cleaner is lowered through the chimney, engagement of the scrub members with material on the chimney walls urges them outwardly against the walls to enhance their cleaning action. During up motion of the cleaner, forces applied to the scrub members by the chimney walls have the opposite effect of tending to collapse the scrub members, freeing them from the walls and easing the upward motion.

The invention also resides in the scrub members of the cleaner being made from expanded sheet metal, and still further resides in the frame of the cleaner including two opposite side walls having cutting edges at their lower ends for chopping material from the chimney walls and also giving the cleaner an open box-like construction permitting the free passage of smoke, gas and other combustion products while the cleaner is in use in a chimney.

DESCRIPTION OF THE PREFERRED EMBODIMENT

Figure 2:
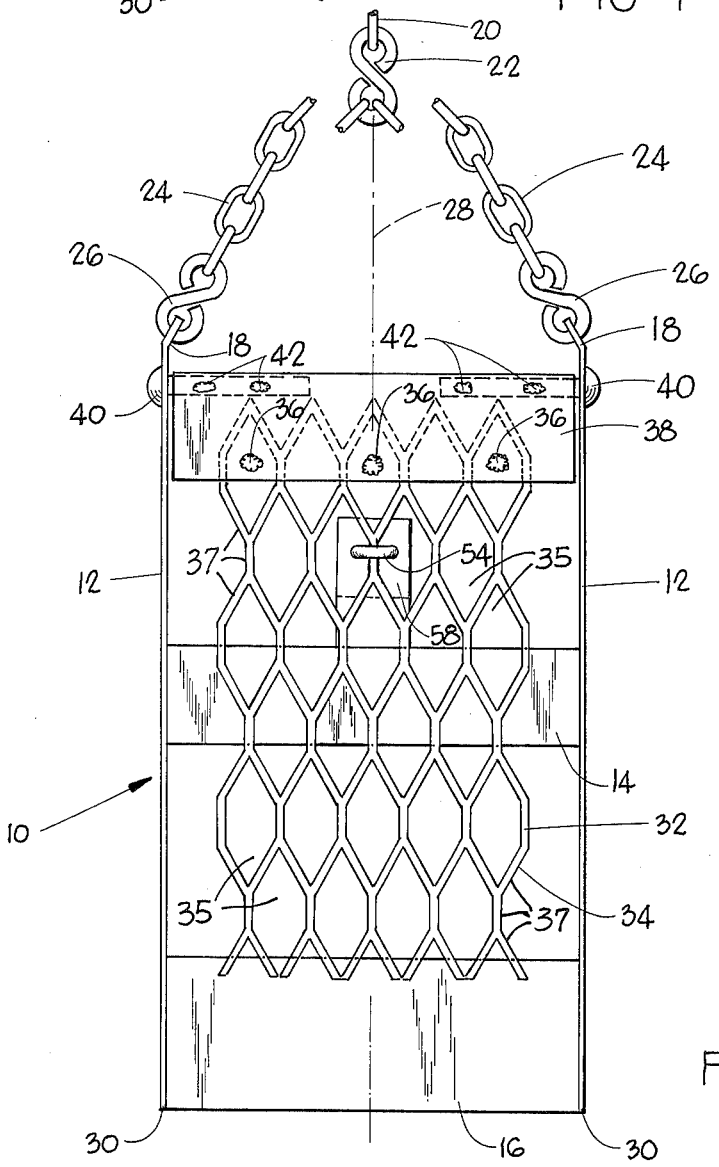
FIG. 2 is a front elevational view of the chimney cleaner of FIG. 1.

Turning to the drawings, a chimney cleaner embodying this invention is indicated generally at 10. It includes a frame comprised of two vertical sheet metal side walls 12, 12 arranged parallel to one another and connected by two horizontal bars 14 and 16 welded at their opposite ends to the side walls. At its upper end each side wall includes an inwardly bent portion 18 which is apertured to adapt the frame for connection to a flexible suspension member for use in lowering and raising the cleaner into and out of a chimney flue. The flexible element may be of various different forms, such as a rope, chain or cable, without departing from the invention and in the illustrated case, as shown in FIG. 2, is a chain 20 connected to the frame by an S-hook 22, two chain segments 24, 24 and two other S-hooks 26, 26. When the frame is suspended from the chain 20, and, therefore, orientated as shown in the drawings, it has a vertical central axis 28.

The side walls 12, 12 of the cleaner have, at their lower ends, downwardly facing edges 30, 30 which may be used to chop material from chimney walls as hereinafter described in more detail.

Figure 3:
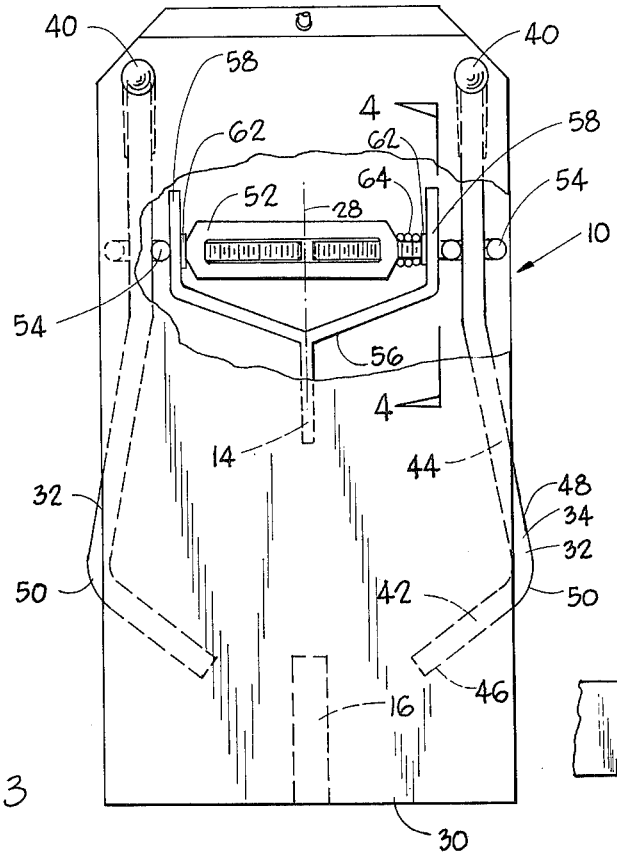
FIG. 3 is a side elevational view of the chimney cleaner of FIG. 1, a portion of the foreside wall being shown broken away to reveal other details of construction.
Figure 5:
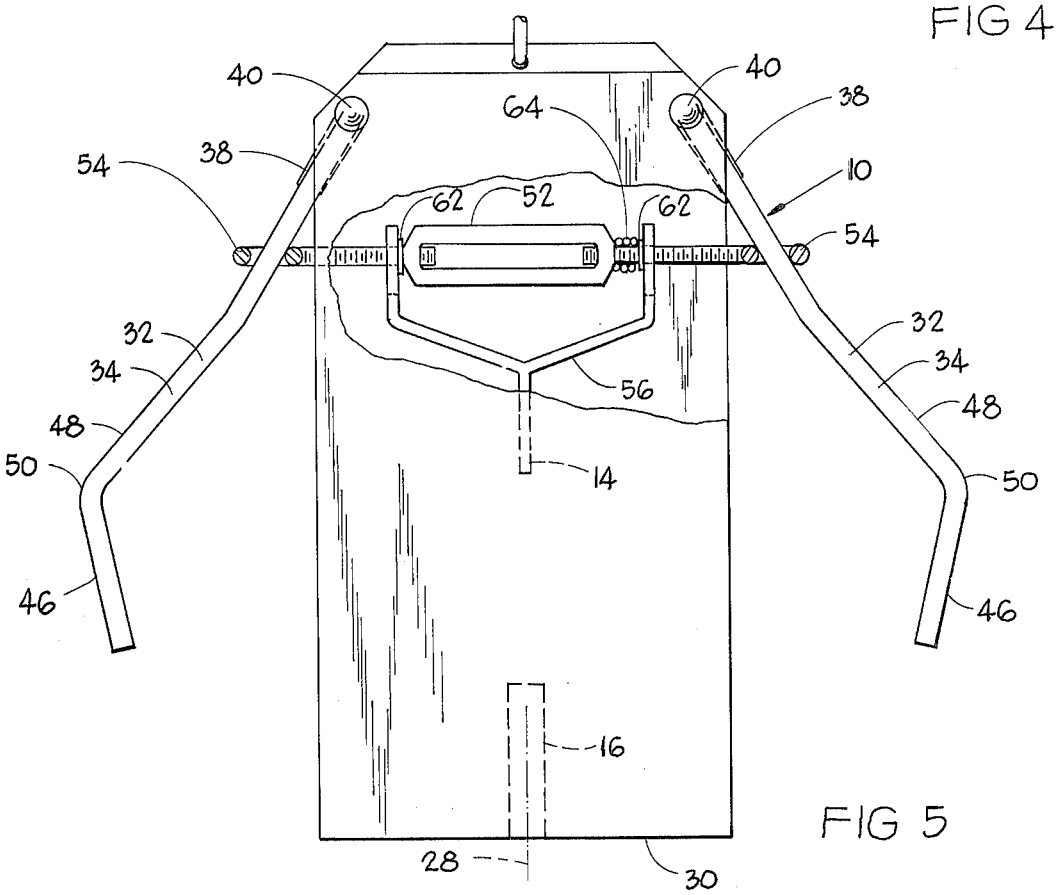
FIG. 5 is a view similar to FIG. 3 but shows the cleaner with its scrub members adjusted to suit a larger size chimney flue than in the case of FIG. 3.

The frame of the cleaner 10, as above described, carries two scrub members 32, 32 which are pivotally connected to the frame for movement about pivot axes located on opposite sides of the central axis 28 and located in a common horizontal plane when the frame is in the normal orientation shown by the drawings. Without departing from the broader aspects of the invention, the scrub members may take various different forms, but preferably and as shown they are each basically composed of a part 34 of expanded sheet metal. That is, the part 34 is made of sheet metal which has been slit and stretched to provide an open mesh or network structure having a plurality of openings 35, 35 defined by a multiplicity of interconnected arms 37, 37. Except for being bent along two horizontal lines as shown in FIGS. 3 and 5, each expanded sheet metal part 34 is of essentially rectangular shape. At its upper end, each part 34 is received between the arms of a U-shaped sheet metal connector 38 and is fixed to the connector by spot welds, as at 36, 36. The pivotal support for each scrub member includes two rivets 40, 40 each passing through a respective one of the frame walls 12, 12, each extending into the bend of the associated connector 38 and each spot welded to the connector as at 42, 42, the common axis of the two rivets 40, 40 therefore defining the pivot axis for movement of the scrub member relative to the frame.

As shown best in FIGS. 3 and 5, the expanded metal part 34 of each scrub member extends generally downwardly from its associated pivot axis, defined by the rivets 40, 40 and is bent along two transverse lines to define a lower end portion 42 and an adjacent portion 44 located above the lower portion. The lower end portion 42 provides a surface 46 facing generally downwardly and outwardly from the central axis 28, whereas the adjacent portion 44 provides a surface 48 facing generally upwardly and outwardly relative to the central axis 28. Between the two surfaces 46 and 48 is a transition area 50 at which the horizontal displacement of the scrub member from the central axis 28 is maximum.

Figure 1:
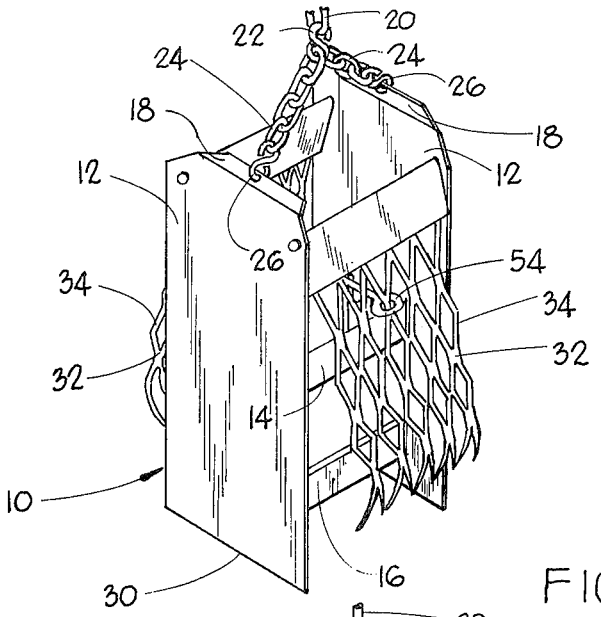
FIG. 1 is a perspective view of a chimney cleaner embodying this invention.
Figure 4:
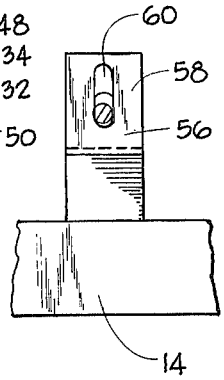
FIG. 4 is a sectional view taken on the line 4—4 of FIG. 3.

Associated with the two scrub members 32, 32 is a means for holding them at a variable minimum spacing from one another while allowing them at least a small amount of spreading movement beyond such minimum spacing. Such holding means may vary in form without departing from the invention, but in the illustrated case it comprises a turnbuckle having a body 52 threadably receiving two eye members 54, 54. The turnbuckle is supported from the frame by a yoke 56 welded to the bar 14 and having two spaced vertical arms 58 located on opposite sides of the body 52 and each having an upwardly opening slot 60, as shown in FIG. 4, for receiving the shank of one of the eye members 54. Between the left-hand yoke arm 58 and the turnbuckle body 52 is a washer 62 and between the right-hand arm 58 and body 52 is a spring 64 and washer 62, the spring 64 serving to frictionally hold the body 52 in whatever position of adjustment it is set. The eye portion of each eye member 54, as shown in FIGS. 1 and 2, loosely captures a portion of the associated expanded sheet metal part 34.

FIG. 3 shows the turnbuckle adjusted to provide a minimum spacing between the two transition areas 50, 50 of the two scrub members to adapt the cleaner for use with a minimum size flue. FIG. 5 shows the turnbuckle adjusted to provide a maximum spacing between the transition areas 50, 50 thereby adapting the cleaner for use with a maximum size flue. Intermediate adjustments may of course also be made to suit intermediate sized flues. It will be understood, however, that in all cases the two eye members of the turnbuckle hold the two scrub members to prevent them from moving inwardly toward the central axis 28 beyond given positions determined by the particular setting or adjustment of the turnbuckle; but because of the looseness between the eye members and the scrub members, the scrub members may move slightly in a spreading direction from such given positions.

In the operation of the above-described chimney cleaner, it may be used in either a chopping mode or a scrubbing mode. In the chopping mode, it may be lowered through a chimney with one or the other of the side walls 12, 12 close to one of the walls of the chimney to cause its lower edge 30 to chop obstructions from the chimney wall. For example, in a new masonry chimney, such obstructions may be chunks of excess mortar which squeezed into the flue through joints during construction, or in an old chimney the obstructions to be chopped away may be hardened accumulations of soot or tar. Also, in a severely clogged old chimney, it may be lowered through the chimney, preferably with the scrub members collapsed to a minimum spacing, to chop a passage through the clogged material with both chopping edges 30, 30. In the scrubbing mode of operation, the turnbuckle is first adjusted to spread the two scrub members to a point at which the two transition areas 50, 50 thereof are spaced apart from one another by a distance approximately equal to or only a very little less than the spacing between the two walls of the chimney to be cleaned. The cleaner is then lowered through the chimney and, as it is so lowered, the two scrub members engage and scrub or scrape soot and other undesired material from the chimney walls. Further, as the surfaces 46, 46 of the scrub members engage material on the chimney walls, the forces exerted through the surfaces 46, 46 onto the scrub members tend to further spread the scrub members relative to one another thereby forcing the transition areas 50, 50 into firm engagement with the chimney walls and enhancing the cleaning action. On the other hand, as the cleaner is raised through the chimney, forces which are exerted on the scrub members through the surfaces 48, 48 will tend to collapse the two scrub members toward one another to thereby ease the upward movement of the cleaner.

We claim:

1. A chimney cleaner comprising: a frame adapted for suspension from a flexible support and when so suspended having a given orientation and a vertical axis, two scrub members located on opposite sides of said vertical axis, means connecting said two scrub members to said frame about two spaced parallel pivot axes fixed relative to said frame and located in a common horizontal plane when said frame is in said given orientation, each of said scrub members extending generally downwardly from its associated one of said pivot axes, each of said scrub members having a lower end portion extending a substantial distance in the direction parallel to said pivot axes and providing a first surface facing generally downwardly and outwardly from said central axis, each of said scrub members further having an adjacent portion located above and adjacent said lower end portion which adjacent portion provides a second surface facing generally upwardly and outwardly from said central axis, said first and second surfaces of each scrub member joining one another along a transition area adapted to engage the wall of the chimney being cleaned and at which transition area the scrub member has a maximum spacing from said central axis, and holding means located between said two scrub members, said holding means including two end portions each connected to a respective one of said scrub members with a loose fit so as to prevent the associated scrub members from moving inwardly toward said central axis beyond a given inner limit while allowing it at least a small amount of free movement in the opposite direction, to thereby hold said two chimney wall engageable transition areas apart from one another by a minimum spacing while allowing them at least a small amount of free spreading movement beyond such minimum spacing, said holding means also including means for adjustably varying the spacing of said two end portions thereof to thereby vary said minimum spacing of said transition areas, said two scrub members each being biased solely by gravity toward its said inner limit and being movable away from said inner limit to increase the spacing of said transition areas by forces arising from contact with a chimney wall during a chimney cleaning operation.

2. A chimney cleaner as defined in claim 1 further characterized by said holding means comprising a turnbuckle located between said two scrub members, said turnbuckle having an elongated body and two eye members threadably received by said body at its opposite ends, each of said eye members including means connecting it to an associated one of said scrub members with a loose fit to permit said scrub member to move a small, limited amount relative to said eye member about its associated one of said pivot axes.

3. A chimney cleaner as defined in claim 1 further characterized by at least said lower end portion and said adjacent portion of each of said scrub members being made of a metal network structure having a plurality of openings defined by a multiplicity of interconnected arms.

4. A chimney cleaner as defined in claim 1 further characterized by said frame including thin metal a part providing a downwardly facing chopping edge fixed relative to said frame in a plane perpendicular to said pivot axes and located to one side of said scrub members.

5. A chimney cleaner as defined in claim 1 further characterized by said frame including two thin metal parts providing two downwardly facing chopping edges fixed relative to one another in planes perpendicular to said pivot axes and located on opposite sides of said scrub members.

6. A chimney cleaner comprising: a frame adapted for suspension from a flexible support and having two horizontally spaced vertical side walls made of sheet metal, each of said side walls terminating at its lower end in a downwardly facing chopping edge, two scrub members connected to said frame for pivotal movement relative to said frame about two horizontally spaced pivot axes extending perpendicular to said side walls and located adjacent the upper ends of said side walls, each of said scrub members extending generally downwardly from its associated one of said pivot axes and each of said scrub members having below its associated one of said pivot axes a scrubbing portion adapted for scrubbing engagement with a chimney wall, each of said scrub members including a metal part of network structure providing said scrubbing portion thereof, adjustable holding means for holding said two scrub members at selected spread conditions relative to one another, said adjustable holding means including a turnbuckle having a body threadably receiving two eye members with each eye member loosely capturing a portion of the expanded metal part of the associated scrub member, said frame including two transversely extending bars connected to and extending between said two side walls, and a yoke connected to one of said bars having two upwardly extending arms each with an upwardly opening slot, said body of said turnbuckle being located between said two arms of said yoke with each of said eye members of said turnbuckle having a shank received in a respective one of said slots.

7. A chimney cleaner as defined in claim 6 further characterized by each of said scrub members having a lower end portion extending a substantial distance in the direction parallel to said pivot axes and providing a first surface facing generally downwardly and outwardly from said central axis, each of said scrub members further having an adjacent portion located above and adjacent said lower end portion which adjacent portion provides a second surface facing generally upwardly and outwardly from said central axis, said first and second surfaces of each scrub member joining one another along a transition area at which transition area the scrub member has a maximum spacing from the central axis of the frame.

* * * * *